US006035616A

United States Patent [19]

Pickett

[11] Patent Number: 6,035,616

[45] Date of Patent: Mar. 14, 2000

[54] SUSPENDED CANTLE SUPPORT

[76] Inventor: Dee Pickett, 17826 Chicken Dinner Rd., Caldwell, Id. 83605

[21] Appl. No.: 09/090,893

[22] Filed: Jun. 4, 1998

[51] Int. Cl.[7] ..... B68C 1/00

[52] U.S. Cl. ..... 54/44.5; 54/44.1

[58] Field of Search ..... 54/44.1, 44.3, 54/44.5

[56] References Cited

U.S. PATENT DOCUMENTS

| | | | |
|---|---|---|---|
| 84,186 | 11/1868 | Hayden | 54/44.1 |
| 307,615 | 11/1884 | Adams et al. . | |
| 5,018,340 | 5/1991 | Marshall | 54/66 X |
| 5,383,327 | 1/1995 | Dohln | 54/44.1 |
| 5,685,133 | 11/1997 | Travis | 54/44.7 |

*Primary Examiner*—Robert P. Swiatek

*Attorney, Agent, or Firm*—Craig M. Korfanta

[57] ABSTRACT

A suspended cantle support which forces the rider's hips forward and down in the saddle by engaging the lower lumbar region of the rider's back. The suspended cantle support here includes a cushion having a relatively soft interior such as one or more layers of closed-cell foam covered by a durable cover. The cover includes a pair of strap lugs formed at the lower bottom corners of the cushion for attachment of straps to attach the cushion to a saddle. Four straps are used to attach the cushion to a saddle. Two straps are attached to each side of the cushion. The cushion is attached to the saddle by looping a first strap through the back cinch D-ring on the saddle and a second strap through an upper D-ring. Both straps are secured in their respective buckles. The other pair of straps on the other side of the cushion are secured in the same manner on the other side of the saddle. The rider mounts and dismounts in the normal manner.

8 Claims, 3 Drawing Sheets

SUSPENDED CANTLE SUPPORT

TECHNICAL FIELD OF THE INVENTION

This invention generally relates to riding saddles for horses and the like. More particularly, this invention relates to a flexible support structure suspended in front or across the cantle portion of a saddle to position and support a rider in a saddle.

BACKGROUND OF THE INVENTION

Several different saddle configurations exist for horses and other similar animals suitable for riding depending upon the particular application. One of the more popular configurations is a typical western saddle which is used for everything from competition calf roping, steer wrestling and barrel racing to commercial ranching and leisure riding. For most competition riding in a western style saddle, it is desirable for the rider to be positioned forward in the saddle with his or her buttocks firmly planted in the seat of the saddle. Oftentimes this position is difficult to maintain, especially in the heat of competition. Very little, if anything has be developed to address this problem.

U.S. Pat. No. 5,383,327 to Dohln teaches a therapeutic saddle for handicapped persons which includes a rigid back support assembly and cooperating abdominal restraint system which positions and holds a handicapped person in an upright sitting position on a saddle. A similar therapeutic saddle is taught in U.S. Pat. No. 5,685,133 to Travis. An alternate embodiment of this saddle includes an inflatable cushion attached to the seat face of the cantle.

While these inventions are well suited to positioning riders, especially handicapped riders in an upright position in a there respective saddles, they do not provide proper positioning for non-disabled riders, nor do they allow for quick mounting and dismounting required for competition use.

What is needed is a saddle configuration which positions the rider forward in the saddle with his or her buttocks planted firmly against the seat of the saddle.

SUMMARY OF THE INVENTION

The present invention provides a suspended cantle support which forces the rider's hips forward and down in the saddle by engaging the lower lumbar region or upper buttocks portion of the rider's back. One embodiment of the suspended cantle support here includes a main support member in the form of a cushion having relatively soft interior such as one or more layers of closed-cell foam covered by a durable fabric or leather enclosure, which is attachable to a saddle via an attachment mechanism. The interior of the cushion can include varying density layers to alter the stiffness of the cantle cushion. Also, the thickness and material of the enclosure or cover can be selected accordingly to vary the relative stiffness of the cantle cushion.

In one embodiment of the invention, the attachment mechanism has a pair of strap lugs formed at the lower bottom corners of the cushion. Straps can be attached to the strap lugs to attach the cushion to a saddle. Here, four straps are used to attach the cushion to a saddle. Two straps may then be attached to each side of the cushion by looping each strap through the strap lugs. A keeper loop may be fixed around two portions of the strap after it is folded over on itself. One end of the strap may be provided with a buckle while the other is provided with a series of cooperating holes to provide adjustable length attachment. It should be noted that the exact mechanism for attaching the cushion can be varied and if adjustable length straps are used, mechanisms other than buckles can be used as well.

Here, the cushion is attached to the saddle by looping a first strap through the back cinch D-ring on the saddle and a second strap through an upper D-ring which is affixed under the back saddle string or concho behind the cantle. A similar D-ring is attached to the other side. Both straps are secured in their respective buckles. The other pair of straps on the other side of the cushion are secured in the same manner on the other side of the saddle.

Another embodiment of the suspended cantle support includes a main support member which is configured as a flexible elongated strap manufactured from a material such as a relatively thick strap leather, a flexible plastic or rubber, or a similar material.

Yet another embodiment of the invention has the attachment mechanism, e.g. attachment straps, formed as an integral part or extension of the main support member.

The suspended cantle support is positioned in front of the cantle at the back of the saddle seat. When the rider is positioned on the saddle he or she wedges the upper portion of his or her buttocks under the cantle cushion. In doing so, the cantle cushion conforms to the lower lumbar portion of the rider, forcing the rider forward and down in the saddle. Otherwise, the rider mounts and discounts in the normal manner.

An additional advantage the invention offers is to provide an adjustable saddle in the sense that the saddle seat can be effectively shortened using the suspended cantle support to accommodate different riders.

DETAILED DESCRIPTION OF THE INVENTION

Figure 1:
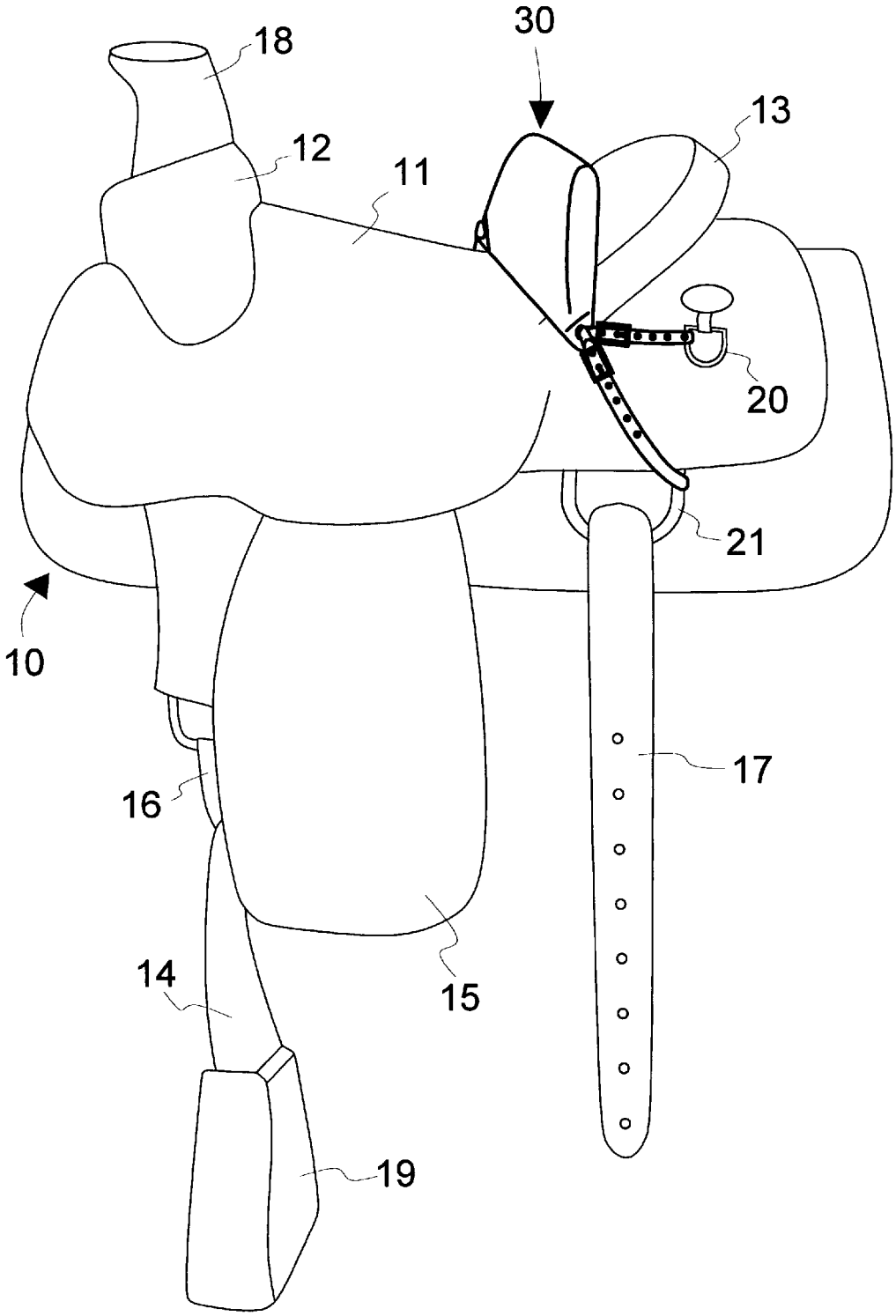
FIG. 1 is a side perspective view of one embodiment of the suspended cantle support attached to a saddle according to the invention.
Figure 2:
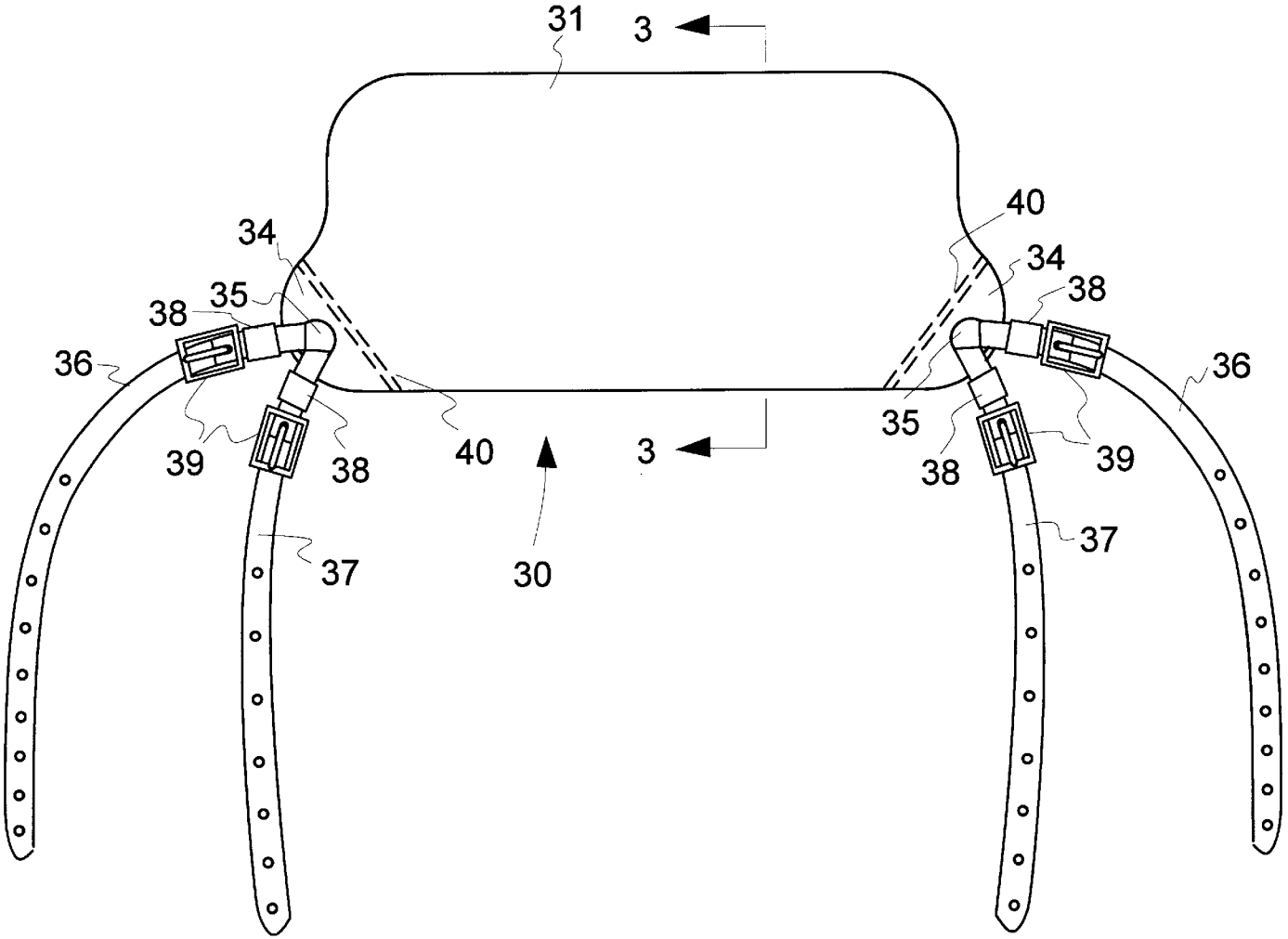
FIG. 2 is a front side view of one embodiment of the suspended cantle support according to the invention.
Figure 3:
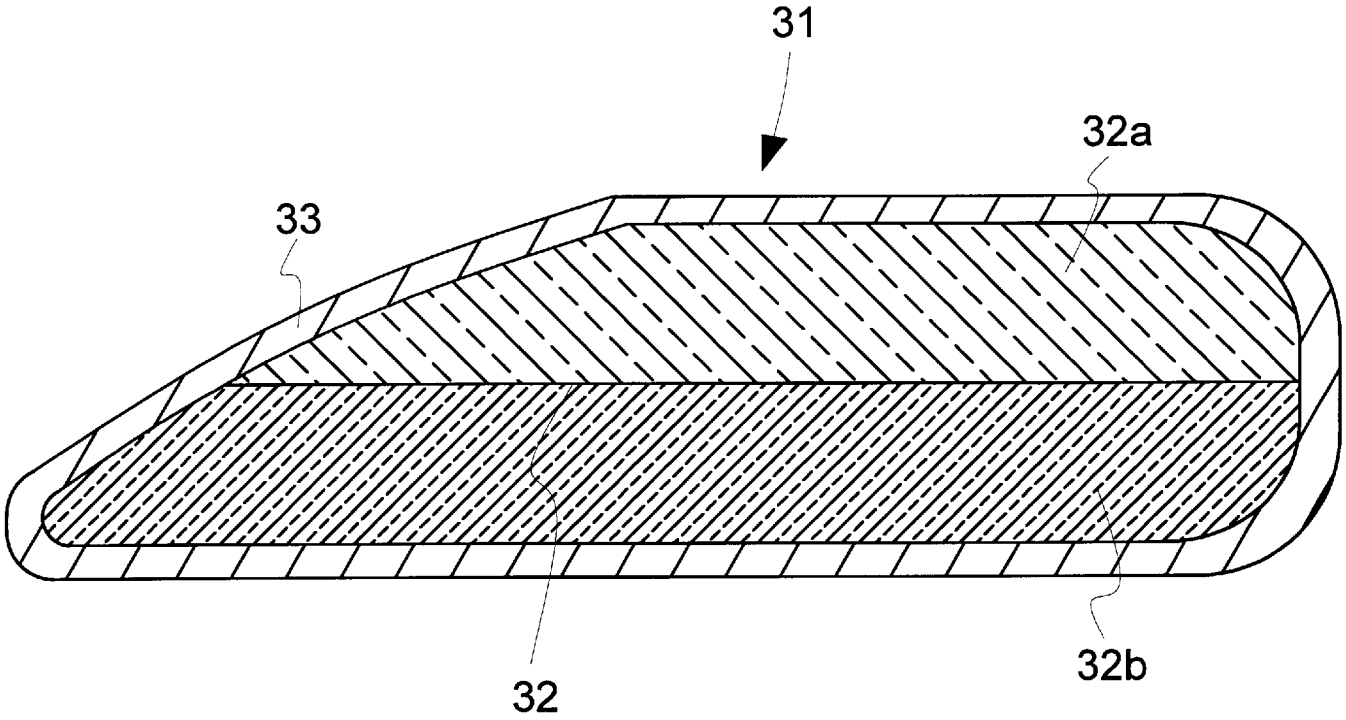
FIG. 3 is a cross-section view taken along section line 3—3 of FIG. 2.

Referring now to the figures, one embodiment of a suspended cantle support is shown in detail and generally designated as 30. FIG. 1 shows suspended cantle support 30 attached to a typical western style saddle 10 which includes a seat 11 having a pommel 12 formed at the front of the saddle and a cantle 13 formed at the back. As with most western style saddles, a saddle horn 18 is attached on the top of pommel 12, a stirrup 19 is attached to each side via a stirrup leather 14 which is shielded by a fender 15. Front and back girth straps 16 and 17 are provided to attach saddle 10 to a saddle animal such as a horse. Back girth strap 17 is attached to saddle 10 using back cinch D-rings 21 on each side of saddle 10. Upper D-rings 20, or other attachment mechanisms such as saddle strings, are provided on the rear upper side of saddle 10 for attachment of various accessories. Conchos are also sometimes in used in place of the saddle strings to attach the back leather to the saddle tree. In this case, upper D-rings 20 or a similar attachment mechanism can be substituted for the conchos and even the saddle strings if desired.

Suspended cantle support 30 has a main support member 31, or cushion, which here includes a relatively soft interior structure 32 such as one or more layers of closed-cell foam covered by a durable fabric or leather enclosure or cover 33. Interior structure 32 can include varying density layers to alter the stiffness of cushion 31 and the thickness and material of cover 33 can be selected accordingly to vary the relative stiffness of cushion 31. Cushion 31 is here formed in a generally rectangular or trapezoidal shape with rounded corners. Main support member 31 can also take the form of a narrower elongated cushion or an elongated, flexible strap manufactured from strap leather, flexible plastic or a similar material.

In this embodiment, cover 33 includes a pair of strap lugs 34 formed at the lower bottom corners of cushion 31 for attachment of straps 36 and 37 to attach cushion 31 to saddle 10. Strap lugs 34 are advantageously reinforced during construction of cushion 31. Here, strap lugs 34 are formed by separating the bottom comer portions of cover 33 using seams 40. A blind seam may be used at the corners to provide reinforcement. Strap holes 35 are then formed in the lug portions of cover 33 to complete strap lugs 34.

Four straps are used to attach cushion 31 to saddle 10, one pair of straps on each side. A back cinch D-ring strap 36 and an upper D-ring strap 37 are attached to each side of cushion 31 by looping each strap through strap lugs 34. A keeper loop 38 is fixed around two portions of each strap after it is passed through lug 34 and folded over on itself. One end of each strap is provided with a buckle 39 while the other is provided with a series of cooperating holes to provide adjustable length attachment. Another embodiment of the invention has one or more attachment straps integrally formed with main support member 31.

Suspended cantle support 30 is attached to saddle 10 by looping strap 36 through back cinch D-ring 21 and strap 37 through upper D-ring 20, or saddle strings (not shown). Both straps are secured in their respective buckles. The other pair of straps on the other side of cushion 31 are secured in the same manner on the other side of saddle 10. Suspended cantle support 30 is positioned in front of cantle 13 at the back of seat 11. When the rider is positioned on saddle 10 he or she wedges the upper portion of his or her buttocks under cantle cushion 31. In doing so, cantle cushion 31 conforms to the lower lumbar portion of the rider, forcing the rider forward and down in saddle 10. Otherwise, the rider mounts and discounts in the normal manner.

While particular embodiments of the invention have been illustrated and explained in detail, various modes of carrying out the invention are contemplated as being within the scope of the appended claims. Therefore, it is to be understood that the scope of the invention is not to be so limited and should be set forth in the appended claims.

What is claimed is:

1. A suspended cantle support for attachment to a saddle which comprises:

a generally flexible main support member;

at least one attachment mechanism extending from opposing points of the main support member, the at least one attachment mechanism being configured to attach the main support member to a saddle; and a second attachment mechanism extending from each of the opposing points to attach the main support member to a saddle.

2. The suspended cantle support of claim 1 wherein the opposing points are strap lugs formed at opposing bottom corners of the main support member.

3. The suspended cantle support of claim 2 wherein the at least one attachment mechanism is a strap including a buckle and cooperating holes.

4. The suspended cantle support of claim 3 wherein the main support member is a cushion.

5. The suspended cantle support of claim 2 wherein the main support member is a cushion.

6. The suspended cantle support of claim 1 wherein the at least one attachment mechanism is a strap including a buckle and cooperating holes.

7. The suspended cantle support of claim 6 wherein the main support member is a cushion.

8. The suspended cantle support of claim 1 wherein the main support member is a cushion.

* * * * *